US011571782B2

(12) United States Patent
Lai et al.

(10) Patent No.: US 11,571,782 B2
(45) Date of Patent: Feb. 7, 2023

(54) SINGLE BODIED PLATEN HOUSING A DETECTION MODULE FOR CMP SYSTEMS

(71) Applicant: Taiwan Semiconductor Manufacturing Co., Ltd., Hsinchu (TW)

(72) Inventors: Tsung-Lung Lai, Hsinchu (TW); Cheng-Ping Chen, Taichung (TW); Shih-Chung Chen, Hsinchu (TW); Sheng-Tai Peng, Hsinchu (TW); Rong-Long Hung, Hsinchu (TW)

(73) Assignee: TAIWAN SEMICONDUCTOR MANUFACTURING CO., LTD., Hsinchu (TW)

( * ) Notice: Subject to any disclaimer, the term of this patent is extended or adjusted under 35 U.S.C. 154(b) by 573 days.

(21) Appl. No.: 16/672,099

(22) Filed: Nov. 1, 2019

(65) Prior Publication Data

US 2020/0164481 A1 May 28, 2020

Related U.S. Application Data

(60) Provisional application No. 62/772,600, filed on Nov. 28, 2018.

(51) Int. Cl.

| | |
|---|---|
| ***B24B 37/16*** | (2012.01) |
| ***B24B 49/12*** | (2006.01) |
| ***B24B 37/013*** | (2012.01) |

(52) U.S. Cl.

CPC ..... *B24B 37/16* (2013.01); *B24B 37/013* (2013.01); *B24B 49/12* (2013.01)

(58) Field of Classification Search

CPC ..... B24B 37/16; B24B 37/013; B24B 37/00; B24B 37/34; B24B 37/12–16;

(Continued)

(56) References Cited

U.S. PATENT DOCUMENTS

2004/0192169 A1* 9/2004 Kimura ..... B24B 37/205 451/6
2005/0024047 A1* 2/2005 Miller ..... G01B 7/10 324/231

(Continued)

FOREIGN PATENT DOCUMENTS

JP H08118231 A * 5/1996

*Primary Examiner* — Joel D Crandall
*Assistant Examiner* — Michael A Gump
(74) *Attorney, Agent, or Firm* — Seed IP Law Group LLP

(57) ABSTRACT

The present disclosure provides a chemical mechanical polishing system having a unitary platen. The platen includes one or more recesses within the platen to house various components for the polishing/planarization process. In one embodiment, the platen includes a first recess and a second recess. The first recess is located under the second recess. An end point detector is placed in the first recess and a detector cover may be placed in the second recess. A sealing mean is provided in a space between the end point detector and the detector cover to prevent any external or foreign materials from coming in contact with the end point detector. A fastener used for fastening the detector cover to the platen also provides addition protection to prevent foreign materials from coming in contact with components received in the recesses.

17 Claims, 7 Drawing Sheets

(58) Field of Classification Search
CPC ..... B24B 37/015; B24B 37/04; B24B 37/046; B24B 37/30; B24B 37/205; B24B 37/10; B24B 37/105; B24B 37/107; B24B 37/20; B24B 49/12; B24B 49/10; B24B 49/105; B24B 49/14; B24B 49/16; B24B 7/228
USPC ..... 451/6
See application file for complete search history.

(56) References Cited

U.S. PATENT DOCUMENTS

2010/0015889 A1* 1/2010 Shimizu ..... B24D 7/12 451/6
2011/0281510 A1* 11/2011 Swedek ..... B24B 37/26 51/296
2014/0273745 A1* 9/2014 Swedek ..... B24B 37/013 451/1

* cited by examiner

SINGLE BODIED PLATEN HOUSING A DETECTION MODULE FOR CMP SYSTEMS

PRIORITY CLAIM AND CROSS-REFERENCE

This application claims the benefit and priority to U.S. Application No. 62/772,600, filed Nov. 28, 2018, the entirety of which is hereby incorporated by reference.

BACKGROUND

Chemical mechanical polishing or chemical mechanical planarization (CMP) is an important step in semiconductor manufacturing. The CMP utilizes the combined effects of chemical and mechanical interactions for polishing and planarizing surfaces. That is, the CMP is used to achieve a substantially planar and smooth surface of a material layer or layers, such as semiconductor, dielectric and metallization layers on a workpiece, such as a semiconductor wafer. When the purpose is to remove surface materials, it is referred to as chemical mechanical polishing. On the other hand, when the purpose is to flatten a surface, it is referred to as chemical mechanical planarization. This manufacturing process is used to fabricate, for example, integrated circuits, microprocessors, memory chips or the like.

One step of the CMP process for polishing and planarizing the material layers on a workpiece is dispensing chemical slurry between the workpiece and a pad where the workpiece contacts the pad with an applied downforce. Slurry is typically a colloid having abrasive and corrosive features. After the slurry is applied and the CMP process is complete, the pad and a platen supporting the pad are cleaned of the slurry residue for later use.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
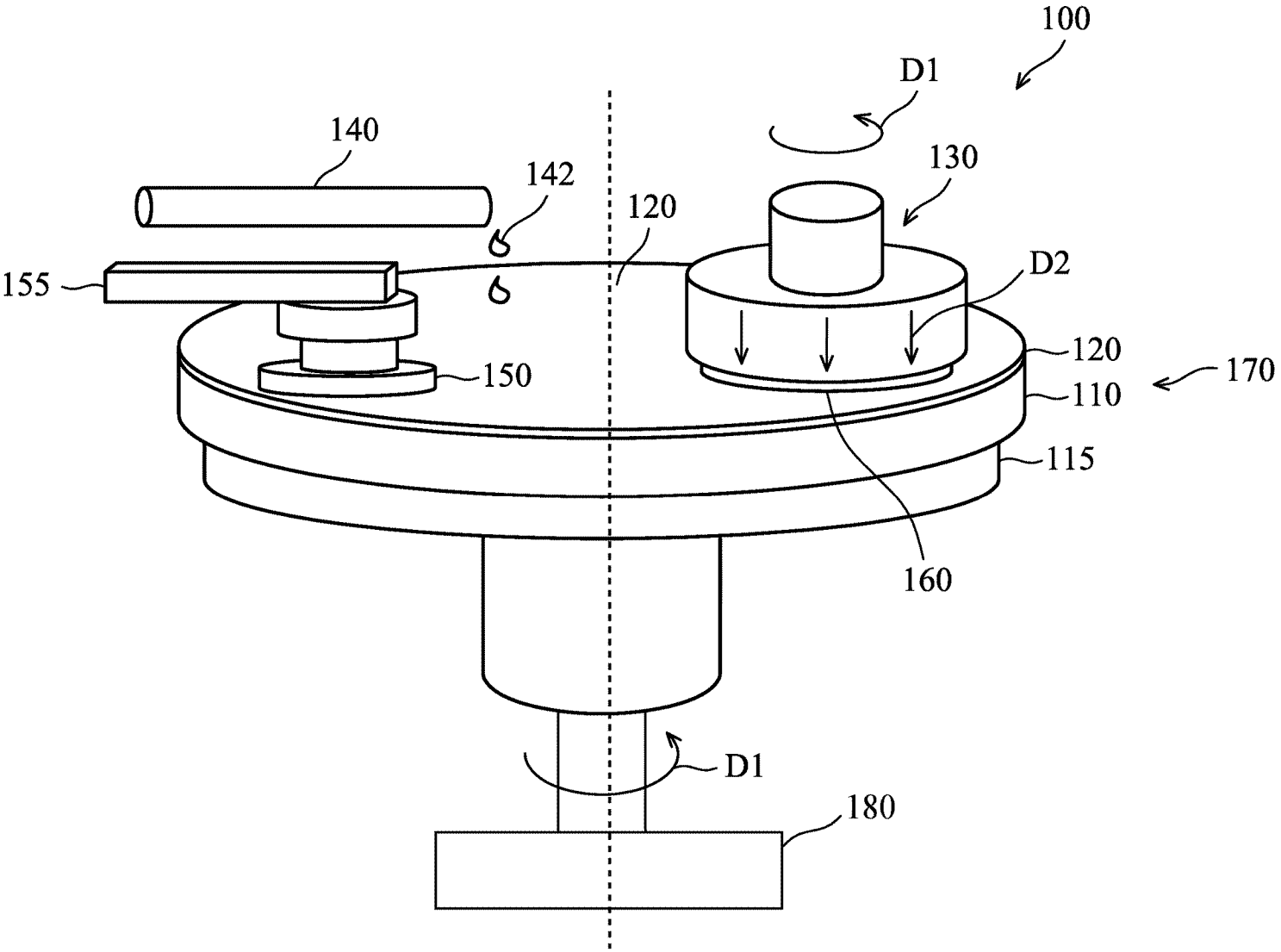
FIG. 1 schematically illustrates a perspective view of a portion of a CMP device according to one embodiment of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The device may be otherwise oriented (rotated 90 degrees or at other orientations) and the spatially relative descriptors used herein may likewise be interpreted accordingly.

The present disclosure is directed to a single-body or unitary platen for use in chemical mechanical polishing/planarization (CMP) devices and CMP systems. A platen structure according to the related art uses an upper platen which is separate and distinct from a lower platen structure. In such platen structures of the related art, the upper platen is overlaid on the lower platen and an end point detector, for example, is mounted on the lower platen and within a portion of the upper platen. In such platen structures according to the related art, a space or gap exists between the upper platen and the lower platen. However, when a fluid, such as slurries or deionized water (DIW), is applied during the rotation of the platen structure, the fluid permeates into the gap between the upper platen and the lower platen. The slurries, which have corrosive characteristics, may damage components placed on the lower platen as well as components disposed between the lower platen and the upper platen. Further, the slurries can also affect other components of the CMP device they come in contact with, e.g., bearings beneath the lower platen for supporting the rotation of the lower platen during a polishing or planarization process.

Figure 3:
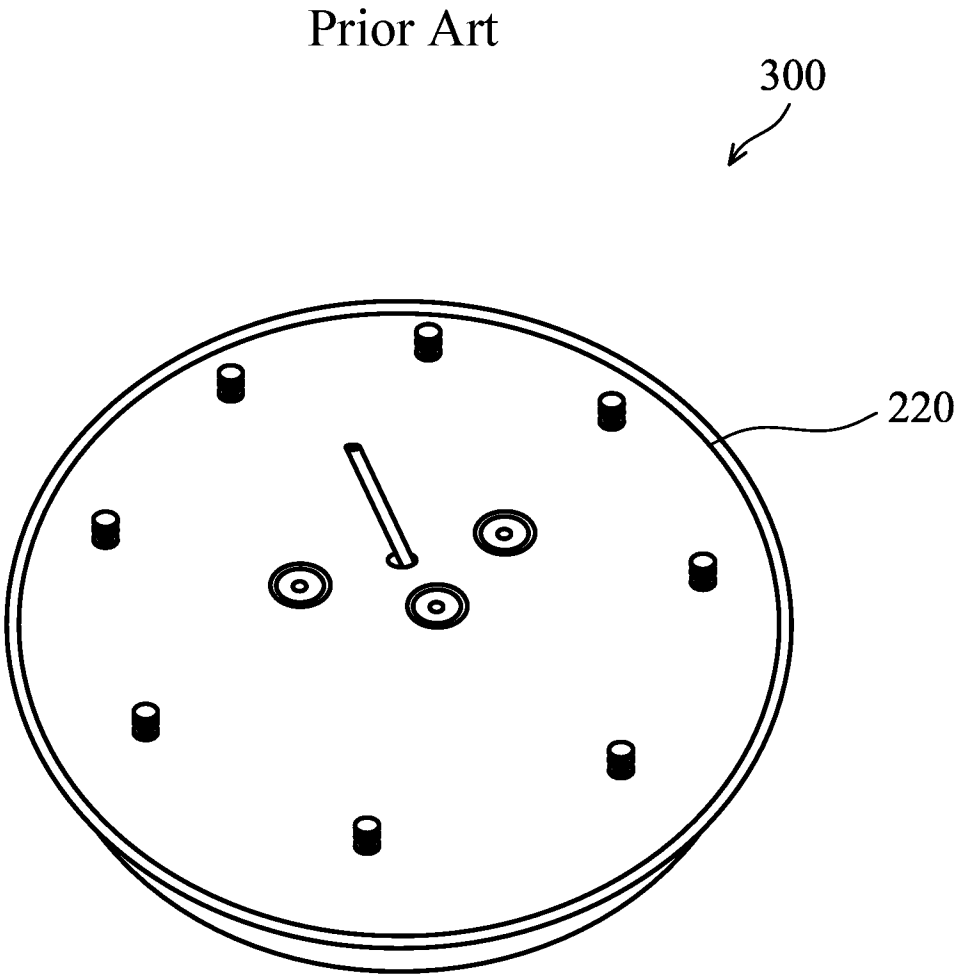
Prior Art Fig. 3
FIG. 3 is a perspective view of an unused lower platen in the related art.

FIG. 3 is a perspective view of a normal unused lower platen. However, when the lower platen is used numerous times the surface of the lower platen deteriorates as well as the surface of the other components that come in contact with the surface of the lower platen. For example, when fluid leaks into a gap between the upper and lower platen of the two-part platen structure, undesirable damage to the upper and lower platens can occur, as well as damage to components associated with the upper platen and the lower platen, e.g., an end point detector or a bearing.

One aspect of the present disclosure provides a unitary platen that has a structure that avoids the problem of damage to the platen caused by fluids leaking into a gap between an upper and a lower platen. The single-body platen in accordance with embodiments of the present disclosure may house an end point detector inside a recess of the platen. Platen assemblies in accordance with the present disclosure do not include a gap between an upper and a lower platen into which fluids, such as slurries and/or DIW, can flow and access interior portions of the platen and components housed within the platen. Platen structures in accordance with embodiments of the present disclosure exhibit substantially reduced or no damage as a result of fluids, such as slurries or DIW, causing deterioration of interior portions of the platen and/or components, such as an end point detector or bearing, contained within or connected to the platen.

Another aspect of the present disclosure relates to a platen including a seal ring adjacent to a periphery or contour of a recess within the platen or adjacent a periphery or contour of a component contained within the platen, such as an end point detector. The seal ring provides a barrier to fluids, such as slurries and/or DIW, which gain access to internal locations of the platen. The shape of the seal ring can be any suitable shape that can surround the recess or component and serve as a barrier to fluids entering the recess or coming in contact with the component, such as an end point detector. The seal ring can have any cross-sectional shape. For example the seal ring can have a cross-section that is an O-shape, or a rectangular shape or any other suitable shape that enables the seal ring to provide the desired barrier to fluids. In some cases, the shape and size of the seal ring will depend on the shape and size of the recess and/or component contained in the recess, such as an end point detector and any additional electronic components adjacent to and/or associated with the end point detector.

A further aspect of the present disclosure relates to providing a platen having fasteners around a periphery or contour of a recess in the platen which can receive a peripheral component of the platen, such as an end point detector. The fasteners attach a recess cover positioned to cover a recess formed in the platen. In some embodiments, such recess receives an end point detector, and the recess cover is positioned over the end point detector. In some embodiments, the recess cover includes an optically transparent portion. The optically transparent portion serves as a viewing window for an end point detector capable of detecting and determining the polishing or planarization end point of, for example, a workpiece by interrogating the workpiece with a laser or other suitable light source. When the recess cover is secured to the platen with the fasteners, the seal ring is compressed between the recess cover and the platen and creates a barrier to fluid that comes in contact with the seal ring. This barrier prevents the fluid from coming in contact with components of the platen that are on the side of the seal ring opposite from the side of the seal ring the fluid contacts. In certain embodiments, the fasteners are received by the platen at a location that is on the same side of the seal ring that may be contacted by the fluid.

By employing a platen according to embodiments of the present disclosure, the significant hours required to clean slurries off the platen can be substantially decreased. Moreover, use of a platen in accordance with embodiments of the present disclosure reduces the frequency with which components contained in the platen, such as an end point detector, must be replaced or serviced, thereby lowering the manufacturing cost.

Further aspects of the present disclosure will be now detailed in connection with the Figures.

FIG. 1 schematically illustrates a perspective view of a portion of a CMP device or system 100 according to one embodiment of the present disclosure. As shown in FIG. 1, the CMP system 100 includes a platen 170, a polishing pad 120, a polishing head 130, a slurry dispenser 140, and a pad conditioner 155 having a disk 150. The polishing pad 120 is arranged on the platen 170. The slurry dispenser 140, the polishing head 130, and the pad conditioner 155 are present above the polishing pad 120. The platen 170 includes a circular upper portion 110 and a circular lower portion 115 which are collectively referred to as a platen 170. In one embodiment, the platen 170 according to the present disclosure has a single, seamless, and unitary structure. That is, the platen 170 is a single-body or integral structure with recesses formed therein (see FIG. 4). The single-body or integral structure of a platen 170 formed in accordance with the embodiments described herein is distinct from platen assemblies that include an upper portion that is separate and distinct from a lower portion, which requires the upper and lower portions to be secured to each other, e.g., using fasteners or other means for securing the upper portion to the lower portion. The circular upper portion 110 forms an upper portion of the platen 170 and the circular lower portion 115 forms a lower portion of the platen 170 and as explained, the circular upper portion 110 and the circular lower portion 115 are not a separate pieces, but rather refer to sections or portions of the integral, unitary platen of embodiments of the present disclosure. In some embodiments, the circular upper portion 110 and the circular lower portion 115 are made of different materials. In such embodiments, the circular upper portion and the circular lower portion may be formed separately and fused together to form an integral, unitary platen. An integral, unitary platen in accordance with embodiments of the present disclosure are characterized by an absence of a gap or void space when the circular upper portion is fused to the circular lower portion of the platen. Welding or soldering techniques can be used to fuse the circular upper portion to the circular lower portion provided the welding or soldering does not leave any gaps or void space between the circular upper portion and the circular lower portion of the platen. In other embodiments, the circular upper portion 110 and the circular lower portion 115 are made of the same material. In such embodiments, the platen can be formed by casting or forging the material that will form the platen. Further, in some embodiments, the circular upper portion 110 has different size and shape from the circular lower portion 115. For example, in some embodiments the circular upper portion 110 has a diameter (or a radius) greater than a diameter (or a radius) of the circular lower portion 115. The specific structure of the platen 170 will be explained in detail below. The unitary platen 170 may be formed by cutting a metal using CNC (Computerized Numerical Control Lathe) method. Further, the unitary platen 170 may be coated using a PFA (Perfluoroalkoxy) coating method to form an acid and alkali resistant surface. The present disclosure is not limited to the above forming methods and coating methods and other suitable methods may be employed for forming the unitary platen 170.

The polishing pad 120 is formed of a material that is hard enough to allow the abrasive particles in the slurry 142 to mechanically polish a workpiece 160, such as a wafer, which is between the polishing head 130 and the polishing pad 120. The following description refers to a wafer as one example of workpiece 160; however, the present disclosure is not limited to workpieces that are wafers. On the other hand, polishing pad 120 is soft enough so that it does not substantially scratch or otherwise damage the wafer 160 during the polishing process.

During the CMP process, the platen 170 is supported by a bearing (not shown) that is located beneath the platen 170. The platen 170 and the bearing connected together, cooperate with a mechanism, such as a motor or a drive (not shown), and rotate the polishing pad 120 in a direction D1 around an axis. As the platen 170 and polishing pad 120 are rotating, the polishing head 130 biases the wafer 160 in a direction D2 so that a surface of the wafer is pushed against the polishing pad 120, such that the surface of the wafer 160 in contact with the polishing pad 120 is polished by the slurry 142.

In accordance with embodiments of the present disclosure, the polishing head 130 rotates (e.g., in the direction D1, as shown or the reverse direction), causing the wafer 160 to rotate around an axis of the polishing head 130, and move on the polishing pad 120 at the same time; however, various embodiments of the present disclosure are not limited in this way. In some embodiments of the present disclosure, as shown in FIG. 1, the polishing head 130 and the polishing pad 120 rotate in the same direction (e.g., clockwise or counter-clockwise). In alternative embodiments, the polishing head 130 and the polishing pad 120 rotate in opposite directions.

While the CMP system 100 is in operation, the slurry 142 flows between the wafer 160 and the polishing pad 120. The slurry dispenser 140, which has an outlet over the polishing pad 120, is used to dispense slurry 142 onto the polishing pad 120. In some embodiments, the slurry dispenser 140 may dispense other chemical materials suitable for polishing or planarizing the wafer 160. The material dispensed by the slurry dispenser is not limited to slurries. The slurry 142 includes reactive chemical(s) that react with the surface layer of the wafer 160 and abrasive particles for mechanically polishing the surface of the wafer 160. Through the chemical reaction between the reactive chemical(s) in the slurry 142, the surface layer of wafer 160, and the mechanical polishing, the surface layer of wafer 160 is removed.

As the polishing pad 120 is used, the polishing surface of the polishing pad tends to glaze, reducing the removal rate and overall efficiency. The disk 150 of the pad conditioner 155 is arranged over the polishing pad 120, and is configured to be used to condition the polishing pad 120, e.g., by removing undesirable by-products generated during the CMP process. The disk 150 generally has protrusions or cutting edges that can be used to polish and re-texturize the surface of the polishing pad 120 during a dressing or conditioning process. In some embodiments of the present disclosure, the disk 150 contacts the top surface of the polishing pad 120 when the polishing pad 120 is to be conditioned. During the conditioning process, the polishing pad 120 and the disk 150 are rotated, so that the protrusions or cutting edges of the disk 150 move relative to the surface of the polishing pad 120, thereby polishing and re-texturizing the surface of the polishing pad 120.

Figure 2:
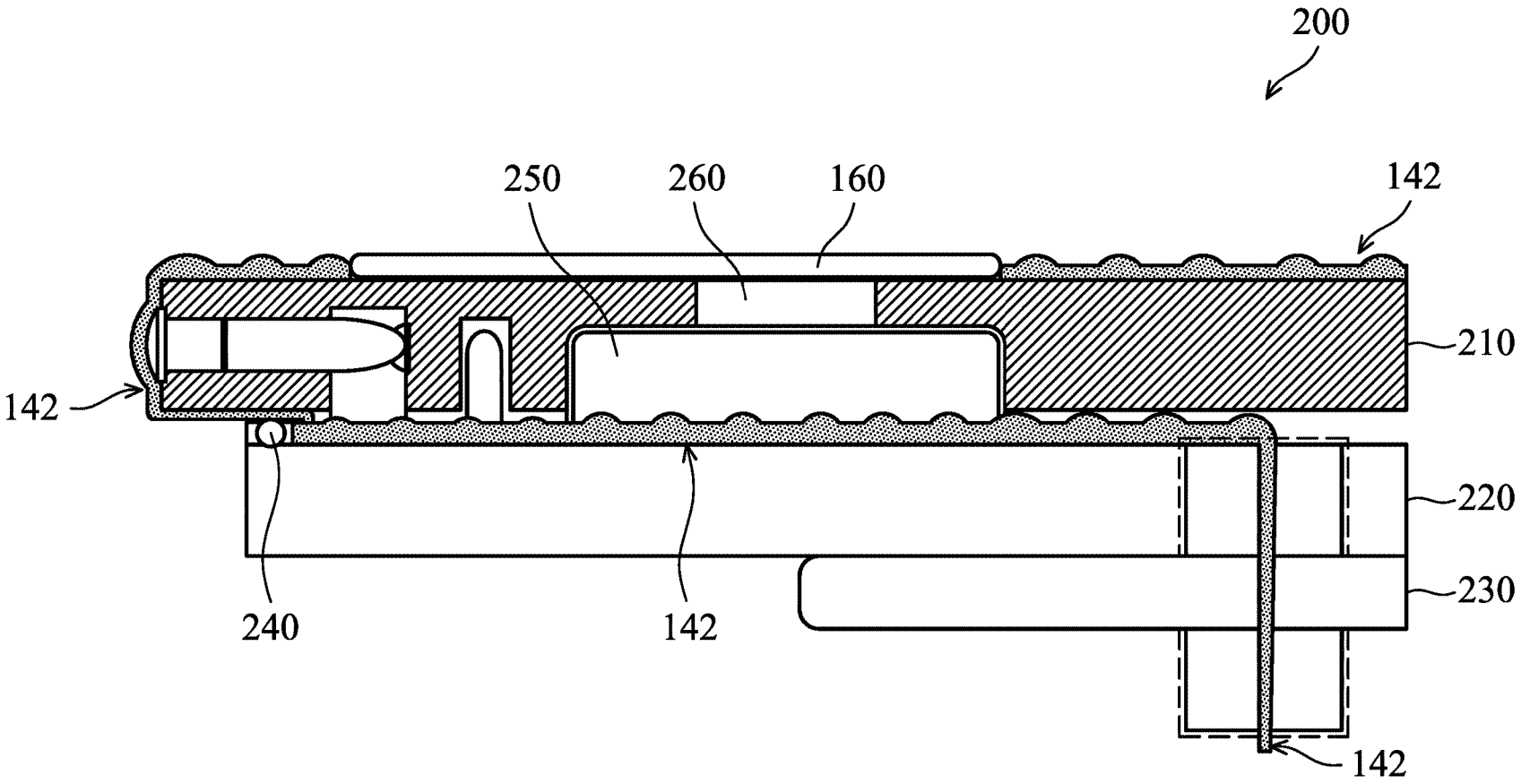
Prior Art Fig. 2
FIG. 2 is a cross-sectional view of a general CMP device of the related art.

FIG. 2 is a cross-sectional view of a CMP device 200 of the related art. The CMP device 200 illustrated in FIG. 2 includes an upper platen 210, a lower platen 220, a bearing 230, a seal O-ring 240, an end point detector 250 and a view port 260. In FIG. 2, a wafer 160 is in contact with the upper surface of the upper platen 210.

The upper platen 210 and the lower platen 220 of the CMP device 200 illustrated in FIG. 2 are two separate structures or pieces that are attached together. The CMP device illustrated in FIG. 2 includes a gap or void between the upper platen 210 and lower platen 220. The end point detector 250 is housed at least partially within the gap or space between the upper platen 210 and the lower platen 220 and at least partially within the upper platen 210. The view port 260 is housed within the upper platen 210. The upper platen 210 includes a recess where the end point detector 250 is placed in a selected location of the upper platen 210. The upper platen 210 and the lower platen 220 are reversibly detachable and attachable to each other so they can be separated from each other when it is necessary to periodically clean the upper platen 210 and the lower platen 220, e.g., when slurry 142 enters the gap or void space between the upper platen 210 and the lower platen 220.

The end point detector 250 is an example of a sensor which forms a part of CMP device 200 and is used to assess the progress of the CMP process and determine when the CMP processing of the wafer 160 should be stopped. In FIG. 2 the wafer 160 is illustrated as being above the upper platen 210. Though not illustrated in FIG. 2, as described above with reference to FIG. 1, in actual use, a polishing pad is provided between upper platen 210 and wafer 160. In FIG. 2, the slurry and DIW 142 used for polishing the wafer 160 during the CMP process is shown in the gap or void between upper platen 210 and lower platen 220. This slurry and DIW 142 in the gap or void flows from between the wafer 160 and the upper platen 210 to the side surface of the upper platen 210, from the side surface of the upper platen 210 to the bottom surface of the upper platen 210, and then into the gap or void between the upper platen 210 and the lower platen 220.

A seal O-ring 240 is located near the outer periphery of the lower platen 220 between the upper platen 210 and the lower platen 220. The purpose of seal O-ring 240 is to block or resist the flow of slurry and DIW 142 into the gap or void between the upper platen 210 and the lower platen 220. However, as shown in FIG. 2, it has been observed that the flow of slurry and DIW 142 are not completely blocked by seal O-ring 240 and the slurry and DIW 142 collect in the gap or void between the upper platen 210 and lower platen 220. The slurry and DIW 142 that collects in the gap or void between the upper platen 210 and lower platen 220 contacts end point detector 250. Even though the drive assembly 180 rotates the upper platen 210 and lower platen 220, the centrifugal force applied to the slurry and DIW 142 on the upper surface of the upper platen 210 is insufficient to prevent the slurry and DIW 142 from flowing around the side and bottom of the upper platen 210 and into the gap between the upper platen 210 and the lower platen 220. In the CMP device illustrated in FIG. 2, the slurry and DIW 142 in the gap between the upper platen 210 and the lower platen 220 flows into a conduit provided in a center portion of the lower platen 220.

FIG. 3 is a perspective view 300 of an unused lower platen 220 in the related art. FIG. 3 illustrates the appearance of a lower platen 220 that has not been corroded by a combination of slurry and DIW 142.

When the slurry and DIW 142 come in contact with the end point detector 250, the bearing 230, the upper platen 210, and/or the lower platen 220, these components of CMP device 200 can be damaged, for example by corrosion caused by the slurry and DIW 142. For example, the dual-platen structure of the related art which includes an upper platen 210 and lower platen 220 is susceptible to the slurry and DIW 142 collecting in the gap between the upper platen 210 and lower platen 220. The slurry and DIW 142, over time, will deteriorate, e.g., corrode, the lower platen 220 as well as components associated with the lower platen 220 that come in contact with the slurry and DIW 142. One or more deteriorated portions may be present on the surface of the platen 220 in FIG. 3 after multiple uses. When such deterioration or corrosion becomes too extensive, it is necessary to replace the end point detector 250, the bearing 230, and/or the platens, which is expensive and time consuming. Even when the corrosion is not so extensive so as to damage the end point detector 250, the bearing 230 or the platens, frequent disassembly and cleaning of the platens, end point detector and/or bearing is necessary and involves significant amount of time (e.g., typically totaling more than about 650 hours per year for a CMP device) which significantly decreases the productivity and the efficiency of the overall CMP process and the semiconductor device manufacturing process.

Figure 4:
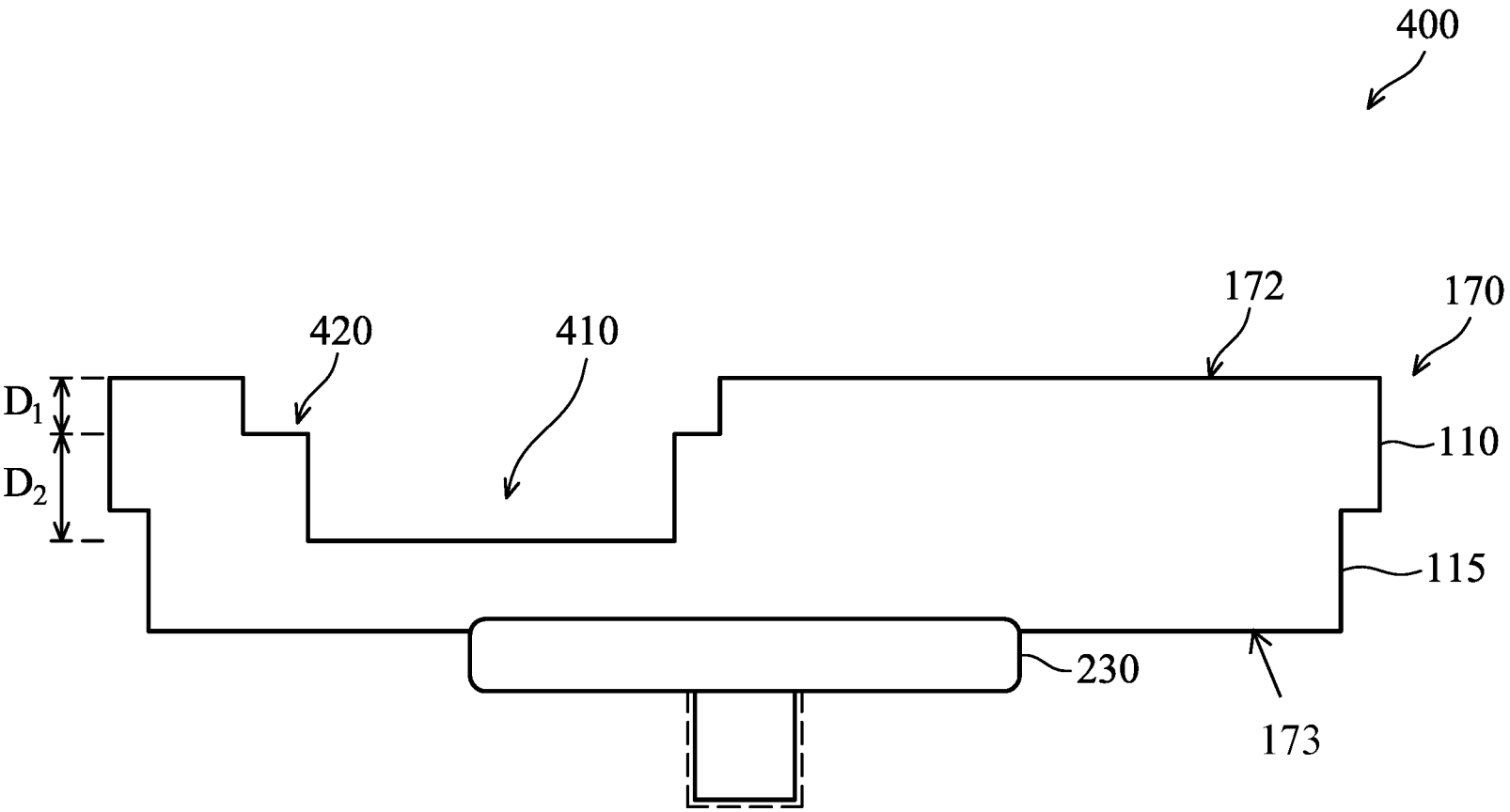
FIG. 4 is a cross-sectional view of a CMP device having a platen according to one embodiment of the present disclosure.

FIG. 4 is a cross-sectional view 400 of a portion of a CMP system 100 including a unitary platen 170 according to embodiments of the present disclosure. As shown in FIG. 4, the CMP device 100 includes a platen 170 having a circular upper portion 110 and a circular lower portion 115. The CMP device 100 also includes a bearing 230 for supporting the platen 170. The bearing 230 cooperates with a rotating mechanism such as a drive assembly 180 to allow the platen 170 to rotate around an axis. For the sake of simplicity, other known components of the CMP device 100 have been omitted.

The circular upper portion 110 comprises the upper portion of the platen 170 and the circular lower portion 115 comprises the lower portion of the platen 170. Unlike the platen structure of the related art, the platen 170 in accordance with some embodiments described herein, is a single, seamless, unitary structure. That is, the platen 170 is made of a single-body structure, e.g., without any gaps or voids between the upper portion and the lower portion of the platen 170 or without any gaps or voids between the upper portion and lower portion of platen 170 which are accessible by fluids, e.g., liquids that come in contact with the platen 170. In other words, in some embodiments of the present disclosure, the circular upper portion 110 and the circular lower portion 115 are not separate structures or pieces. For example, the circular upper portion 110 and the circular lower portion 115 are formed from the same body of materials and are formed as a single unitary structure. In other embodiments, the circular upper portion 110 and the circular lower portion 115 are separate structures or pieces. In such embodiments, these separate structures or pieces are attached to each other such that no gaps or voids exist between the circular upper portion 110 and the circular lower portion 115. Alternatively, in such embodiments, these separate structures or pieces are attached to each other in a way that prevents fluids that come in contact with the platen 170 from gaining access to or collecting in gaps or voids between the circular upper portion 110 and the circular lower portion 115.

In one or more embodiments, the circular upper portion 110 has a different size and shape compared to the size and/or shape of the circular lower portion 115. For example, as shown in FIG. 4, the circular upper portion 110 is larger in size than the circular lower portion 115 (e.g., the circular upper portion 110 has a larger radius or diameter compared to the radius or diameter of the circular lower portion 115). However, in other examples, the circular lower portion 115 is larger in size than the circular upper portion 110 (e.g., the circular lower portion 115 has a greater radius or diameter compared to the radius or diameter of the circular upper portion 110). In one embodiment, the circular upper portion 110 is thinner than the circular lower portion 115. In another embodiment, the circular upper portion 110 is thicker than the circular lower portion 115.

In FIG. 4, a first recess 410 is formed in both a portion of the circular upper portion 110 and a portion of the circular lower portion 115. However, in other embodiments, the first recess 410 is formed in the circular upper portion 110 and the first recess 410 does not protrude into the circular lower portion 115. In some embodiments, a second recess 420 extends into a portion of the circular upper portion 110 but does not extend into the circular lower portion 115 of the platen 170. In other embodiments, the second recess 420 extends through the circular upper portion 110 and partially into the circular lower portion 115. The circular upper portion 110 includes an upper surface 172 on one face of the platen 170 and the circular lower portion 115 includes a lower surface 173 on a face of the platen 170 opposite from the upper surface 172. In some embodiments the lower surface 173 contacts a bearing 230. The second recess 420 extends downward from the upper surface 172 of the platen 170 towards the lower surface 173. The second recess portion 420 has a selected depth $D_1$ extending into the platen 170 from the upper surface 172 and a lateral dimension parallel to the upper surface 172. In some embodiments, the depth $D_1$ of the second recess 420 is less than the depth $D_2$ of the first recess 410. In other embodiments, the depth $D_1$ of the second recess 420 is greater than the depth $D_2$ of the first recess 410. The first recess portion 410 extends from a bottom of the second recess portion 420 towards the lower surface 173 of platen 170. The first recess portion 410 has a lateral dimension parallel to the upper surface 172. The lateral dimension of the first recess is different from or equal to the lateral dimension of the second recess. For example, in some embodiments the lateral dimension of the second recess is greater than the lateral dimension of the first recess. In other embodiments, the lateral dimension of the second recess is less than the lateral dimension of the first recess. In one or more embodiments, the first recess portion 410 and the second recess portion 420 are circular and concentric. In other embodiments, the first recess portion 410 and the second recess portion 420 are not circular or concentric, e.g., see FIG. 7B embodiments. In one or more embodiments, an axis of the first recess 410 and an axis of the second recess 420 are coaxial and spaced apart from the axis of the platen 170. As shown in FIG. 4, the axis of the platen 170 and the axis of the bearing 230 are coaxial such that the platen 170 and the bearing 230 are able to rotate together around the common axis.

In one or more embodiments, a sensor, such as an end point detector (340; shown in FIG. 5) is positioned in the first recess 410. The following description refers to an end point detector 340; however, the present disclosure is not limited to sensors that are end point detectors. The size and shape of the first recess 410 depends on the size and shape of the end point detector 340. For example, the end point detector 340 may have substantially the same depth and lateral dimension of the first recess 410. In other embodiments, any other suitable components, other than an end-point detector, can be incorporated in the platen 170 and these components can be fit inside various recesses in the platen 170. For example, to incorporate additional components within the platen 170, will include additional recesses with various sizes and shapes.

The second recess 420 is formed above the first recess 410. In some embodiments, since the first recess 410 is already formed in the platen 170, a subsequent second recess 420 may be formed by forming a recess that is wider than the first recess 410. In other embodiments, the second recess 420 being a wider and less deep recess (e.g., greater lateral dimension and less deep compared to the first recess 410) can be formed first and thereafter the first recess 410 being a narrower and deeper recess can be formed. The order of forming the first and second recesses 410, 420 may vary depending on the manufacturing process or the design needs.

In some embodiments, a ratio of a diameter of the circular upper portion 110 and a diameter of the circular lower portion 115 may vary based on the manufacturing process or the design needs, as well as the size and shape of the components (e.g., end point detector, detector cover which is described in connection to FIG. 5) embedded in the unitary platen 170. For example, the diameter of the circular upper portion 110 may be greater than the diameter of the circular lower portion 115, and thus the ratio between the two diameters may be greater than 1.

However, in other embodiments, the ratio between the two diameters may be 1. That is, the circular upper portion 110 and the circular lower portion 115 may have the same diameter.

In further embodiments, the circular lower portion 115 may be designed to have a diameter slightly greater than the diameter of the circular upper portion 110, and thus the ratio between the two diameters may be less than 1.

In yet some embodiments, the platen 170 may be designed to have a tapered sidewall shape as well. By having the tapered sidewall shape for the platen 170 may allow the slurries 142 to smoothly slide and fall off to the bottom of the platen 170. The shape of the sidewall of the platen 170 is not limited to the aforementioned shapes and may employ other sidewall shapes as well. For example, when the diameter of the circular upper portion 110 is greater than the diameter of the circular lower portion 115, the sidewall of the circular lower portion 115 may have a circular or a semi-circular sidewall shape. That is, the sidewall of the circular lower portion 115 may extend from the protruded part of the circular upper portion 110 in a curvature. With this sidewall shape, it may also prevent the slurries 142 from permeating inside the platen 170 during operation.

Figure 5:
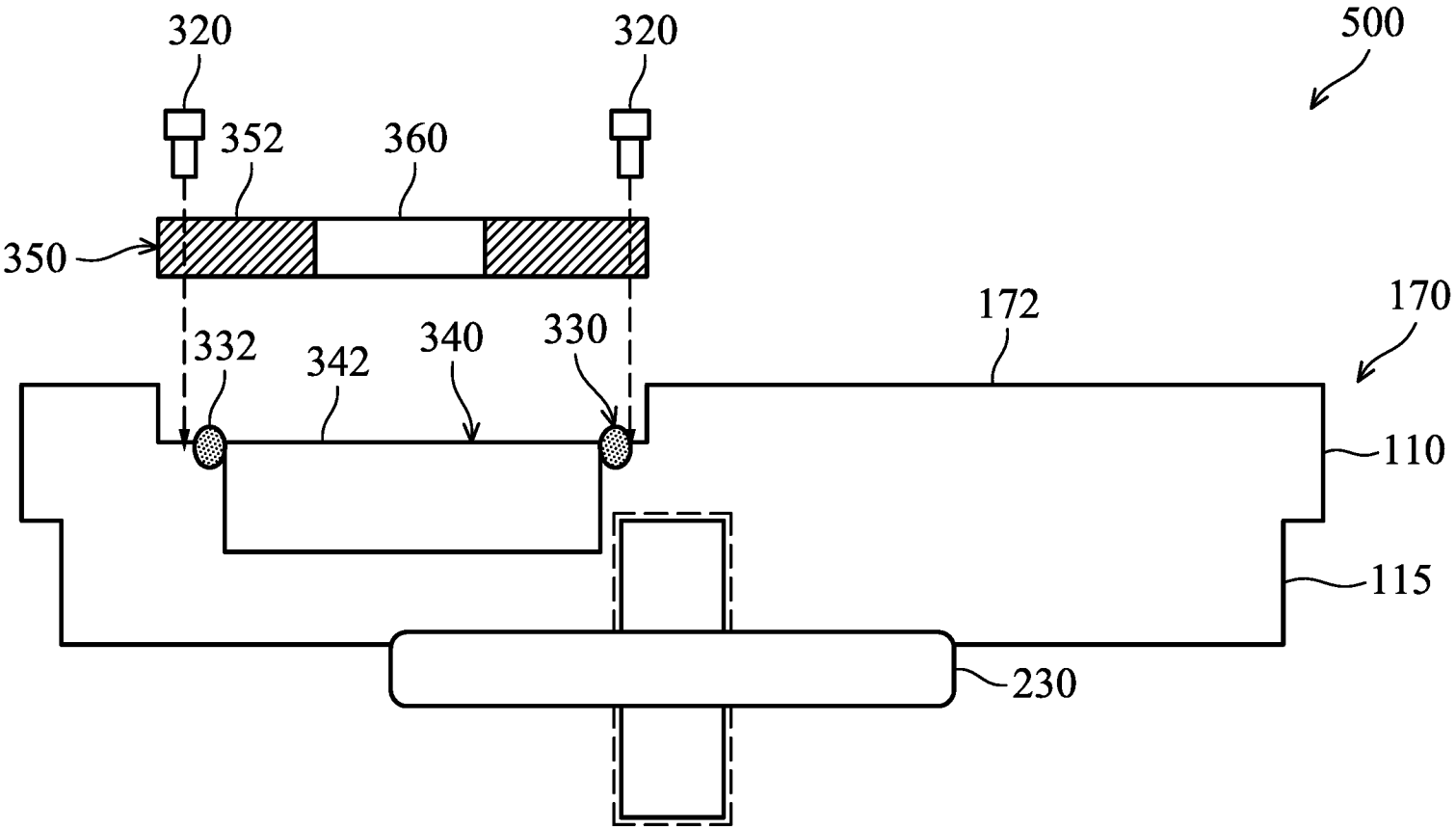
FIG. 5 is a cross-sectional view of a CMP device having a platen with sealing means and fasteners according to the present disclosure.

Referring to FIG. 5, in one embodiment, the end point detector 340 is placed in the first recess 410 and thereafter a detector cover 350 (not shown in FIG. 4) is placed above the end point detector 340 and in the second recess 420. In some embodiments, the detector cover 350 includes a view port 360.

FIG. 5 is a cross-sectional view of a CMP device 500 including a platen 170 with fasteners 320 and sealing means 330 according to embodiments of the present disclosure. As shown in FIG. 5, the CMP device 500 includes a platen 170, an end point detector 340 placed in a first recess 410, a detector cover 350 placed in a second recess 420, fasteners 320 for securing detector cover 350 to circular upper portion 110 and sealing means 330.

The sealing means 330 include any suitable structure for creating a fluid-tight seal at the interface between the circular upper portion 110 of platen 170 and the detector cover 350. In one embodiment, the sealing means 330 include a gasket or a seal ring. The gasket or seal ring can be of any type of material, any suitable lateral shape and any suitable cross-sectional shape. In one embodiment, the gasket will have a lateral shape that is the same as the shape of the end point detector 340 and or the first recess 410 allowing it to be placed around the end point detector 340 or first recess 410. For example, in some embodiments, the gasket defines a lateral shape that is circular or rectangular-shaped or some other shape. The gasket can be made of synthetic rubbers, thermoset, plastic, thermoplastics or any other material that meets the chemical compatibility, sealing pressure, application temperature, lubrication requirements, or other property for creating a fluid-tight seal between the circular upper portion 110 of platen 170 and the underside of detector cover 350. Such fluid-tight seal serves to isolate the end point detector 340 from the slurry and DIW 142 that reaches sealing means 330.

The end point detector 340 interrogates the surface of the workpiece as the CMP process progresses. Signals from the end point detector are used to identify a CMP processing end point for a workpiece, e.g., the wafer 160. For example, the end point detector 340 provides signals that are used by a controller to determine when to stop the CMP process or when to change polishing conditions, such as slurry composition or operating parameters, such as rotation rate of the polishing pad or workpiece. In one embodiment, the signals generated by the end point detector 340 are based on a change in reflection intensity of light from the surface of the wafer 160. That is, the end point detector 340 transmits an incident light onto a the surface of the wafer 160 and measures an intensity of the incident light that is reflected back to the end point detector 340 by the surface of the wafer. In one embodiment, the end point detector 340 emits light and senses the reflected light using a sensor. The emitted light may be a laser. In particular, the laser is applied from the sensor to a surface of the wafer 160 during polishing of the surface and based on the intensity of the laser reflected by the surface, the end point detector 340 generates a signal that is used to assess the progress of the CMP process and ultimately to determine when the CMP processing should come to an end.

In one or more embodiments, the end point detector 340 is used to control the timing to end the polishing. The timing of the end of the polishing can be based on a number of factors, including obtaining uniform thickness of certain layers on the wafer 160 surface and/or to obtain a target thickness of layers on the wafer 160 surface.

In some embodiments, the end point detector 340 has an upper surface 342. In the embodiment illustrated in FIG. 5, the upper surface 342 of the end point detector 340 is substantially coplanar with the top of the first recess 410. In the embodiment of FIG. 5, the top of the first recess 410 is coplanar and partially coincides with a bottom surface of the second recess 420. In other embodiments, the upper surface 342 of the end point detector 340 is not substantially coplanar with the top of the first recess 410. For example, in such other embodiments, the upper surface 342 of the end point detector 340 is below the top of the first recess 410 and below the bottom surface of the second recess 420. In yet other embodiments, the upper surface 342 of end point detector 340 is above the top of the first recess 410 and above the bottom surface of the second recess 420. In these latter embodiments, the lower surface of detector cover 350 includes a recess to accommodate the portion of end point detector 340 that is above the top of first recess 410 and above the bottom surface of the second recess 420.

In FIG. 5, the sealing means 330 is placed in a selected location that is spaced apart from a first surface 342 of the end point detector 340. The selected location may be along a second surface 332 that defines a bottom surface of the second recess 420. In one embodiment, the first surface 342 and the second surface 332 are coplanar. In another embodiment, the sealing means 330 is located at a bottom of the second recess 420 and extends around the first recess 410. In other embodiments, the first surface 342 and the second surface 332 may not be in the same plane and one of the surfaces may be lower or higher than the other surface. Second surface 332 includes a seal seat, e.g., a groove or indention in second surface 332, for receiving the sealing means 330. The seal seat typically has a cross-sectional shape that mates with the cross-sectional shape of the sealing means 330.

The detector cover 350 is received in second recess 420 where it overlies end point detector 340. When the detector cover 350 is placed in the second recess 420 and secured in place by fasteners 320, the gasket or the sealing means 330 is compressed between the underside of detector cover 350 and the platen 170 and provides a barrier to fluids that come in contact with sealing means 330. The detector cover 350 includes a viewing window 360 which passes through detector cover 350. The viewing window 360 is provided so that light emitted by the sensor of the end point detector 340 can pass through detector cover 350 via viewing window 360 for purposes of inspecting the workpiece 160 (e.g., wafer 160). In one embodiment, the viewing window 360 is made of a transparent material so that light emitted by end point detector 340 passes through the viewing window 360, is reflected by workpiece 160 and passes back through the viewing window 360 to the sensor of the end point detector 340. Viewing window 360, is transparent to light or other electromagnetic energy emitted by end point detector 340 and reflected by wafer 160. In some embodiments, the viewing window 360 is encircled by a structural portion 365 that may not be transparent (see FIG. 7A). In further embodiments, the transparent viewing window 360 of the detector cover 350 is substantially aligned with the optical axis of the light emitting sensor of the end point detector 340.

The fasteners 320 are used to attach the detector cover 350 to the platen 170 in the second recess 420. In embodiments in accordance with FIG. 5, fasteners 320 are received into the second surface 332 of the platen 170. In one embodiment, the fasteners 320 pass through the detector cover 350 and reach the second surface 332. Second surface 332 includes threaded bores for receiving threaded ends of fasteners 320. The fasteners 320 are received at a selected location of the second surface 332 that are spaced apart from the end point detector 340 and spaced apart from the selected location of sealing means 330. In embodiments in accordance with FIG. 5, fasteners 320 are received at a location of the second surface 332, such that sealing means 330 is positioned between fasteners 320 and end point detector 340. In one or more embodiments, the fasteners 320 are configured so that slurries and DIW 142 that come in contact with fasteners 320 are prevented from seeping into detector cover 350. For example, a rubber seal ring or gasket is provided between fasteners 320 and detector cover 350 and/or a thread sealing compound is applied to the threads of fasteners 320. Preventing slurries and DIW from seeping into detector cover 350 reduces the risk that slurries and DIW 142 comes in contact with the end point detector 340. In FIG. 5, the fasteners 320 are shown as passing through the detector cover 350 at two locations. However, more fasteners 320 can be employed to perform both fixating the detector cover 350 to the platen 170 and preventing infiltration of slurries and DIW 142 into the platen 170.

The fasteners 320 include any suitable means for coupling the detector cover 350 with the platen 170. In addition, the fasteners 320 include any suitable means that prevents the infiltration of slurries and DIW 142 into the platen 170. In one embodiment, the fasteners 320 include any type of fastener, mechanical joint, or the like. The fasteners 320 can be of any type and shape. In one embodiment, the fasteners 320 include a hardware device that mechanically joins or affixes two or more objects together. These fasteners 320 can be removed or dismantled without damaging the joining component. For example, the fasteners 320 can include bolts, screws, clips, pins, or the like. In other examples, the fasteners 320 do not necessarily have to have hardware, mechanical characteristics. That is, synthetic rubbers, or plastics or any other material that is capable of fixating the detector cover 350 to the platen 170 and preventing the slurry and DIW 142 from penetrating into the platen 170, where the slurry and DIW may contact end point detector 340, may be used.

In accordance with some embodiments of the present disclosure, when the fasteners 320 affix the detector cover 350 to the upper portion of the platen (i.e., circular upper portion 110), the top surface 352 of the detector cover 350 is coplanar, i.e., lies in the same plane, with the top surface 172 of the circular upper portion 110. In one or more embodiments, the tops of fasteners 320 are embedded, recessed or countersunk into the surface 352 of the detector cover 350.

In some embodiments, the depth $D_1$ of the second recess 420 may be based on the thickness of the detector cover 350, and the depth $D_2$ of the first recess 410 may be based on the thickness of the end point detector 340. However, in other embodiments, the depth $D_1$ of the second recess and the depth $D_2$ of the first recess may not be necessarily dependent upon the thickness of these components. Various dimensions of the first and second recess may be utilized. For example, the size and depth of the recess may increase or decrease based on additional components that may be embedded inside the recess.

Figure 6:
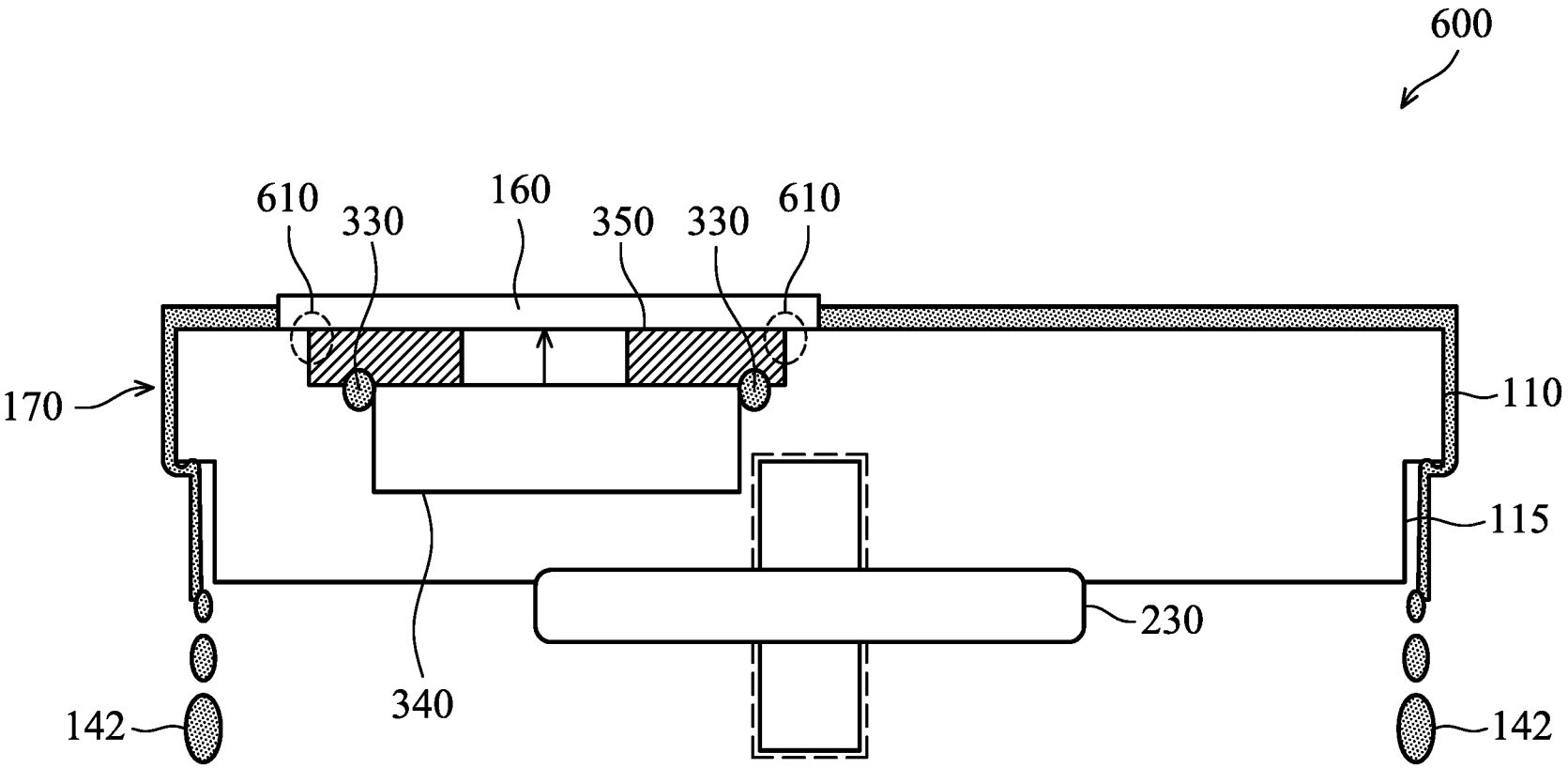
FIG. 6 is a cross-sectional view of a CMP device having a platen according to one embodiment of the present disclosure.

FIG. 6 is a cross-sectional view 600 of a CMP device 100 having a platen 170 according to embodiments of the present disclosure. As shown in FIG. 6, a wafer 160 is overlain on the area of platen 170 that includes end point detector 340. In FIG. 6, the polishing pad 120 between the circular upper portion 110 and wafer 160 and the polishing head 130 have been omitted for simplicity.

Unlike the non-unitary dual-platen structure in the related art, the unitary platen 170 in accordance with embodiments according to the present disclosure does not include a seam or gap between its circular upper portion 110 and its circular lower portion 115 that is exposed on an exterior surface of platen 170 where slurries and DIW 142 can penetrate into platen 170, e.g., into a space between the circular upper portion 110 and the circular lower portion 115. As illustrated in FIG. 6, in accordance with some embodiments of the present disclosure, when a seam or gap between an upper platen 210 in FIG. 2 and a lower platen 220 in FIG. 2 is absent, the slurries and DIW 142 can flow from the top surface 172 of the platen 170, to a vertical side surface of the platen 170 and to the underside of the circular upper portion 110, where the slurries and DIW drip off of the underside of the circular upper portion 110.

In some cases, should slurry and DIW 142 infiltrate into a space 610 between the circular upper portion 110 of the platen 170 and the detector cover 350 or into the portion of detector cover 350 which receives fasteners 320, and find come in contact with the sealing means 330, the infiltration of the slurries and DIW 142 to the end point detector 340 is effectively reduced or prevented by seal means 330. For example, the fasteners 320 and seals or thread sealing compounds associated with fasteners 320 formulate a first blockade against the slurries and DIW 142. Further, even if some slurry and DIW 142 pass the fasteners 320 or seep into a space between detector cover 350 and platen 170, the sealing means 330 formulates a second blockade against the slurry and DIW 142, effectively preventing the slurry and DIW 142 from coming in contact with the end point detector 340.

Figure 7A:
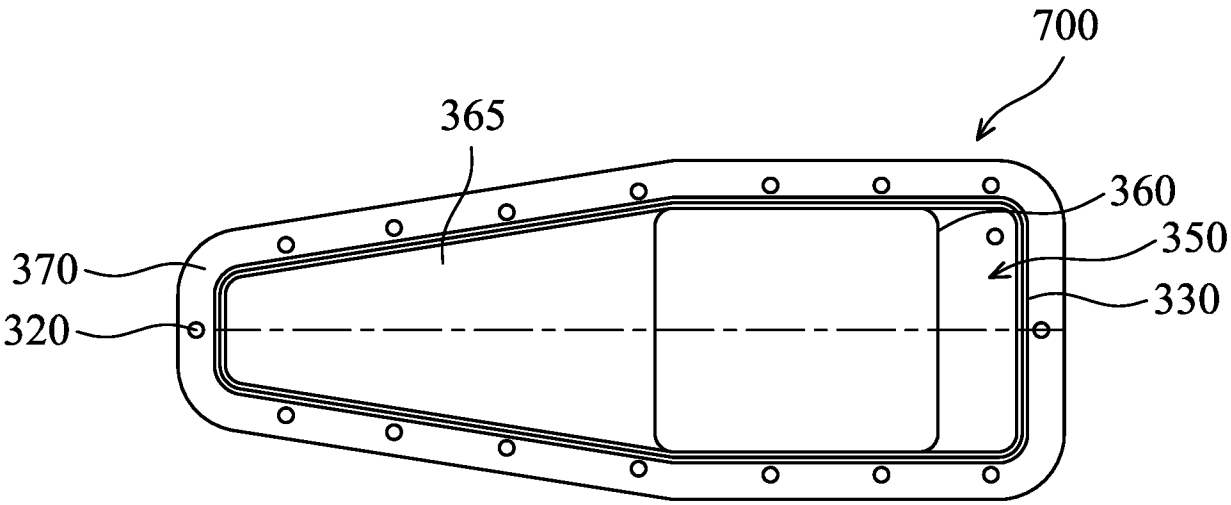
FIG. 7A is a top view of a detector cover of the CMP device according to one embodiment of the present disclosure.

FIG. 7A is a top view 700 of an example detector cover 350 of a CMP device 100 according to embodiments of the present disclosure. In FIG. 7A, for purpose of illustration, the location of the sealing means 330 is described. In one embodiment, the sealing means 330 is located between the platen 170 and the detector cover 350. In some embodiments, an outer portion 370 surrounds the detector cover 350. In the outer portion 370, the fasteners 320 are arranged. In this embodiment, the fasteners 320 are located outside of the location where the sealing means 330 is located. However, in other embodiments, the fasteners 320 can be arranged within the contour of the location where sealing means 330 are placed. Any numbers of fasteners 320 can be used to fix the detector cover 350 to the platen 170.

Figure 7B:
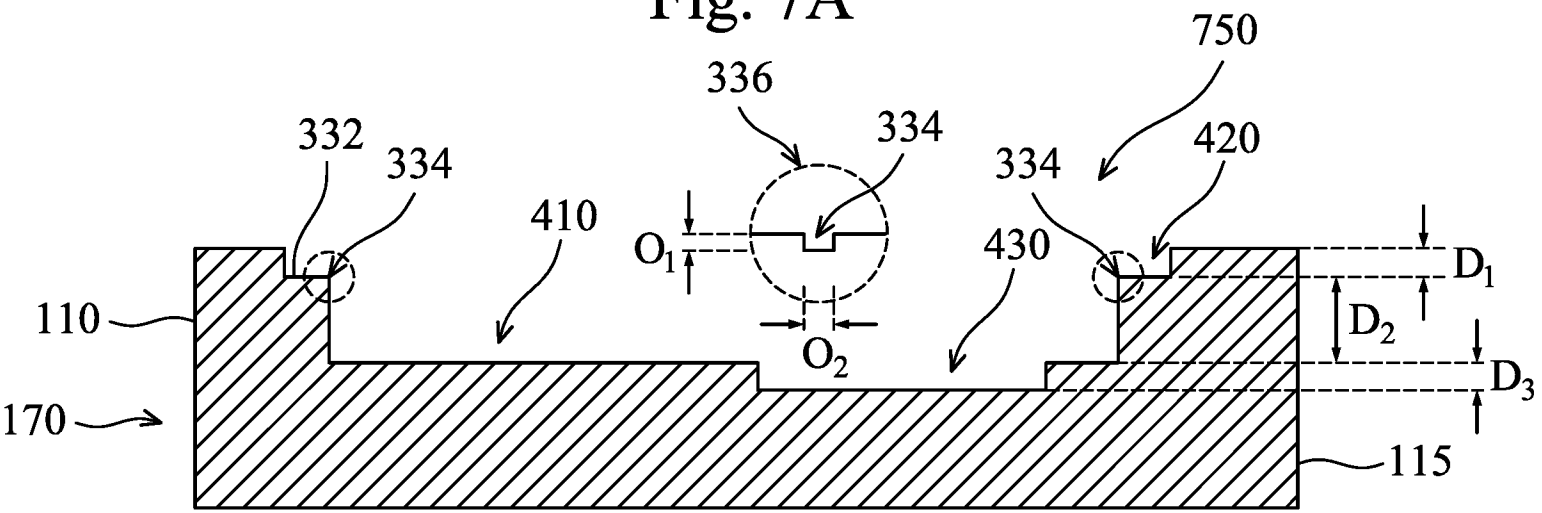
FIG. 7B is a cross-sectional view of a platen according to another embodiment of the present disclosure.

FIG. 7B is a cross-sectional view 750 of a platen 170 according to another embodiment of the present disclosure. In FIG. 7B, a third recess 430 is formed below the first recess 410 and the second recess 420. The third recess 430 may be provided as a space for other suitable components needed to perform and/or monitor the CMP process.

In this embodiment, the circular upper portion 110 and the circular lower portion 115 of the platen 170 have common outer side surfaces. That is, different from the embodiments shown in FIG. 5, e.g., the circular upper portion 110 does not have a larger lateral dimension, e.g., diameter, than the circular lower portion 115. That is, according to embodiments of FIG. 7B, the size and shape of the circular upper portion 110 and the size and shape of the circular lower portion 115 are identical. The thickness/depth of the second recess 420 is denoted as $D_1$; the thickness of the first recess 410 is denoted as $D_2$; and the thickness of the third recess 430 is denoted as $D_3$. The thickness of the recesses $D_1$, $D_2$, $D_3$ may vary based on the depth of components that are to be placed in each second, first, and third recess, respectively. In some embodiments, additional recesses can be formed in the platen 170 for placing other suitable components for the CMP process. Various relationships between the thickness of the recesses $D_1$, $D_2$, $D_3$ may be employed based on various needs.

The surface 332 in the second recess 420 includes a seal seat 334. The sealing means 330 is placed in the seal seat 334.

A view 336 in FIG. 7B shows an enlarged view of the seal seat 334 according to the present disclosure. In one embodiment, the seal seat 334 for the sealing means 330 has a depth $O_1$ and a lateral dimension $O_2$. The depth $O_1$ and the lateral dimension $O_2$ may differ based on the size and dimension of the sealing means 330. In some embodiments, the depth $O_1$ and the lateral dimension $O_2$ will substantially match the size of the sealing means 330 so that no slurry or DIW 142 can pass by the sealing means 330 and come in contact with the end point detector 340.

Platen assemblies according to the present disclosure are less susceptible to failure of sensitive electrical or optical components contained within the platen due to damage caused by slurry and DIW coming in contact with the sensitive components. The seamless, unitary platen structure in accordance with presently disclosed embodiments effectively isolates sensitive components, such as an end point detector housed inside the platen, from foreign and external materials (e.g., slurry, DIW, or any other materials) that could damage the sensitive components. Further aspects of the present disclosure provide a platen having sealing means and fasteners around the periphery or the contour of a end point detector. The sealing means and fasteners are configured to provide additional protection for preventing the slurries from penetrating into the internal locations of the platen. By employing a CMP device or system including a platen according to the present disclosure, damage to sensitive components, housed within the platen, resulting from the sensitive component coming in contact with slurry and/or DIW that leaks in the platen is reduced. Reducing damage to such sensitive components, reduces the time required for engineers to clean slurries off a platen and to repair or replace damaged components. Such reduction in time for maintenance or repair translates into a lower cost of manufacturing.

In one embodiment of the present disclosure, a platen for a chemical mechanical polishing system includes a unitary platen including an upper surface on one face of the platen and a lower surface on an opposite face of the platen. The platen, in operation, rotates around an axis. The first recess portion in the upper surface of the platen has a depth extending into the platen from the upper surface and a lateral dimension parallel to the upper surface.

The platen includes a second recess portion in the platen. The second recess portion has a depth and extending from a bottom of the first recess portion into the platen towards the lower surface of the platen. The second recess portion has a lateral dimension parallel to the upper surface. The lateral dimension of the second recess portion is different than the lateral dimension of the first recess portion.

Another aspect of the present disclosure provides a chemical mechanical polishing system including a platen and a drive assembly. The drive assembly is coupled to the platen. The drive assembly is configured to rotate the platen in a selected direction.

In one embodiment, the platen includes a unitary platen including a pad surface on one face of the platen, a drive assembly surface on an opposite face of the platen and an axis, around which, in operation, the platen rotates.

In one embodiment, the platen further includes a first recess portion extending from the pad surface of the unitary platen towards the drive assembly surface.

In one embodiment, the platen further includes a second recess portion extending from a bottom of the first recess portion into the platen towards the drive assembly surface. A distance between the bottom of the first recess portion and a bottom of the second recess portion is greater than a distance between the pad surface and the bottom of the first recess portion.

Yet another aspect of the present disclosure provides a chemical mechanical polishing system including a platen configured for mounting a substrate. The platen includes: a unitary platen including a first surface on one face of the platen, a second surface on an opposite face of the platen, and an axis adjacent to the second surface, around which, in operation, the unitary platen rotates; a first recess portion extending from the first surface of the unitary platen towards the second surface; a second recess portion extending from a bottom of the first recess portion into the unitary platen towards the second surface, a distance between the bottom of the first recess portion and a bottom of the second recess portion being greater than a distance between the pad surface and the bottom of the first recess portion; and a third recess portion extending from a bottom of the second recess portion towards the second surface of the unitary platen.

In one embodiment, the second recess portion includes a lateral dimension parallel to the first surface that is less than a lateral dimension of the first recess portion parallel to the first surface.

In one embodiment, the third recess portion includes a lateral dimension parallel to the first surface that is less than a lateral dimension of the second recess portion parallel to the first surface.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

The invention claimed is:

1. A unitary platen for a chemical mechanical polishing system, comprising:

an upper surface on one face of the platen, a lower surface on an opposite face of the platen and an axis around which, in operation, the platen rotates;

a first recess portion in the upper surface of the platen, the first recess portion having a depth extending into the platen from the upper surface and a lateral dimension parallel to the upper surface;

a second recess portion in the platen, the second recess portion having a depth and extending from a bottom of the first recess portion into the platen towards the lower surface of the platen, the second recess portion having a lateral dimension parallel to the upper surface, the lateral dimension of the second recess portion being different than the lateral dimension of the first recess portion;

a sealing means at the bottom of the first recess portion and extending around the second recess portion; and a detector cover in the first recess portion, the detector cover including a transparent portion transparent to optical wavelengths and an upper surface, the upper surface of the detector cover being substantially coplanar with the upper surface of the platen.

2. The platen of claim 1, wherein the platen includes a circular upper portion and a circular lower portion below the circular upper portion, the circular upper portion having a diameter greater than a diameter of the circular lower portion.

3. The platen of claim 2, wherein the second recess portion extends through a portion of the circular upper portion and into a portion of the circular lower portion of the platen.

4. The platen of claim 1, wherein the lateral dimension of the first recess portion is larger than the lateral dimension of the second recess portion.

5. The platen of claim 1, wherein the first recess portion and the second recess portion are radially spaced apart from the axis of the platen.

6. The platen of claim 1, wherein the depth of the first recess portion is less than the depth of the second recess portion.

7. The platen of claim 1, further comprising:

a detector in the second recess portion, the detector having an upper surface, the upper surface of the detector being substantially coplanar with an upper surface of the second recess portion.

8. The platen of claim 1, further comprising:

fasteners extending through the detector cover and into the platen, wherein the sealing means is compressed between the detector cover and the platen.

9. The platen of claim 1, further comprising a third recess portion extending from a bottom of the second recess portion towards the lower surface of the platen.

10. The platen of claim 9, wherein the third recess portion includes a lateral dimension parallel to the upper surface of the platen that is less than the lateral dimension of the second recess portion.

11. A chemical mechanical polishing system, comprising:

a unitary platen; and a drive assembly coupled to the platen, the drive assembly configured to rotate the platen in a selected direction, the platen including:

a pad surface on one face of the platen, a drive assembly surface on an opposite face of the platen and an axis, around which, in operation, the platen rotates;

a first recess portion extending from the pad surface of the platen towards the drive assembly surface; and a second recess portion extending from a bottom of the first recess portion into the platen towards the drive assembly surface, a distance between the bottom of the first recess portion and a bottom of the second recess portion being greater than a distance between the pad surface and the bottom of the first recess portion;

a seal seat in the bottom of the first recess portion, the seal seat extending around the second recess portion.

12. The chemical mechanical polishing system of claim 11, further comprising:

a laser detector in the second recess portion, the laser detector having a surface that is substantially coplanar with the bottom of the first recess portion.

13. The chemical mechanical polishing system of claim 11, further comprising:

a laser detector cover in the first recess portion, the laser detector cover including a window transparent to wavelengths of light emitted by a laser detector, wherein a surface of the laser detector cover is substantially coplanar with the pad surface of the platen.

14. The chemical mechanical polishing system of claim 13, wherein the platen includes a circular upper portion and a circular lower portion below the circular upper portion, the circular upper portion having a diameter greater than a diameter of the circular lower portion.

15. The chemical mechanical polishing system of claim 14, wherein the second recess portion extends through a portion of the circular upper portion and into a portion of the circular lower portion of the platen.

16. A chemical mechanical polishing system, comprising:

a unitary platen configured for mounting a substrate, the platen including:

a first surface on one face of the platen, a second surface on an opposite face of the platen, and an axis adjacent to the second surface, around which, in operation, the platen rotates;

a first recess portion extending from the first surface of the platen towards the second surface;

a second recess portion extending from a bottom of the first recess portion into the platen towards the second surface, a distance between the bottom of the first recess portion and a bottom of the second recess portion being greater than a distance between the first surface and the bottom of the first recess portion; and a third recess portion extending from the bottom of the second recess portion towards the second surface of the platen, a detector cover in the first recess portion, the detector cover including a transparent portion transparent to optical wavelengths and an upper surface, the upper surface being substantially coplanar with the first surface of the platen.

17. The chemical mechanical polishing system of claim 16, wherein the second recess portion includes a lateral dimension parallel to the first surface that is less than a lateral dimension of the first recess portion parallel to the first surface, and wherein the third recess portion includes a lateral dimension parallel to the first surface that is less than the lateral dimension of the second recess portion parallel to the first surface.

* * * * *